US011287138B2

(12) United States Patent
Cross et al.

(10) Patent No.: US 11,287,138 B2
(45) Date of Patent: Mar. 29, 2022

(54) COOKING APPLIANCE WITH TOP BREATHING BURNER HAVING BOTTOM BREATHING ASSIST THROUGH TOP SHEET

(71) Applicants: BSH Home Appliances Corporation, Irvine, CA (US); BSH Hausgeräte GmbH, Munich (DE)

(72) Inventors: Conor Cross, New Bern, NC (US); Michael Gerdes, Trent Woods, NC (US); Michael Petrino, Rockport, MA (US); Karthik Sitaraman, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 465 days.

(21) Appl. No.: 16/214,188

(22) Filed: Dec. 10, 2018

(65) Prior Publication Data

US 2020/0182475 A1 Jun. 11, 2020

(51) Int. Cl.

| | |
|---|---|
| ***F24C 3/08*** | (2006.01) |
| ***F23D 14/06*** | (2006.01) |
| ***F24C 15/00*** | (2006.01) |
| ***F24C 3/10*** | (2006.01) |
| ***F23D 14/76*** | (2006.01) |
| ***F24C 15/36*** | (2006.01) |

(52) U.S. Cl.

CPC ..... *F24C 3/085* (2013.01); *F23D 14/06* (2013.01); *F24C 15/001* (2013.01); *F23D 14/76* (2013.01); *F24C 3/103* (2013.01); *F24C 15/36* (2013.01)

(58) Field of Classification Search

CPC .. F24C 3/085; F24C 5/02; F24D 14/06; F24D 14/76; B23B 31/20

USPC ..... 126/39 E, 39 R

See application file for complete search history.

(56) References Cited

U.S. PATENT DOCUMENTS

| | | | | |
|---|---|---|---|---|
| 5,653,219 | A * | 8/1997 | Taplan | F24C 3/085 126/39 H |
| 2011/0265782 | A1* | 11/2011 | Diggins | F23L 9/00 126/39 E |
| 2015/0144123 | A1* | 5/2015 | Cadima | F24C 3/085 126/39 R |
| 2015/0345800 | A1* | 12/2015 | Cabrera Botello | F23D 14/06 126/39 E |

FOREIGN PATENT DOCUMENTS

| | | |
|---|---|---|
| EP | 0581655 A1 | 2/1994 |
| EP | 0990853 A2 | 4/2000 |
| EP | 1016823 A1 | 7/2000 |
| FR | 0693256 A1 | 1/1994 |
| GB | 290055 | 6/1927 |

(Continued)

*Primary Examiner* — Vivek K Shirsat

(74) *Attorney, Agent, or Firm* — Michael E. Tschupp; Andre Pallapies; Brandon G. Braun

(57) ABSTRACT

A domestic home gas cooktop is provided. The cooktop has a top sheet having a primary combustion air hole through the top sheet; a gas burner cup mounted to the top sheet; and a gas burner base mounted to the burner cup. The primary combustion air hole is configured to allow first primary combustion air to flow from beneath the top sheet to the burner base, and the primary combustion air hole is located remotely from the burner cup.

20 Claims, 17 Drawing Sheets

(56) References Cited

FOREIGN PATENT DOCUMENTS

| | | | |
|---|---|---|---|
| JP | S6186521 | A | 5/1986 |
| WO | 2012077050 | A2 | 6/2012 |
| WO | 2014170707 | A1 | 10/2014 |

* cited by examiner

COOKING APPLIANCE WITH TOP BREATHING BURNER HAVING BOTTOM BREATHING ASSIST THROUGH TOP SHEET

FIELD OF THE INVENTION

The invention is directed to an apparatus and method related to optimizing the breathing of a gas cooking burner. More particularly, embodiments of the invention are directed to improvements in a top breathing burner of a domestic gas cooking appliance.

An example of an application for the invention is a domestic kitchen gas cooktop having improved primary combustion air flow. The cooktop can be a gas cooktop mounted in a countertop either with or without a built-in appliance under the cooktop, or a part of a standalone range.

BACKGROUND OF THE INVENTION

Some modern domestic kitchens include a gas cooktop as either a standalone counter mounted cooktop, in combination with an under the counter mounted built-in wall oven, or part of a standalone range.

Some domestic cooktops and other appliances use burners that are known as top breathing burners or cup burners. For simplicity, the term top breathing burner will be used throughout this disclosure, but it is noted that the term top breathing burner is in no way restrictive. A top breathing burner traditionally draws all of its combustion air from above the top sheet of the cooktop.

Applicants recognized a problem that can exist with some top breathing burners in that certain operating conditions (large cooking pots, griddle plates, multiple burners operating simultaneously) can obstruct the air supply and thus reduce or limit the burner combustions performance.

Applicants solved this problem with embodiments of the invention.

SUMMARY

The invention achieves the benefit of improved combustion performance of a top breathing burner of a domestic gas cooking appliance by providing one or more primary combustion air holes in the top sheet of the cooking appliance. The primary combustion air hole(s) in the top sheet can provide primary combustion air in addition to that drawn into the burner from above the top sheet.

Embodiments of the invention are based on the inventors' recognition that adding primary combustion air from below the top sheet and outside of the burner cup results in increased flame stability because the air source is more distant from the gas jet in the burner cup. The inventors recognized that providing the air source more distant form the gas jet reduced the impact on the flame from concussion disturbances and back pressure.

Particular embodiments of the invention are directed to domestic home gas cooktop that has a top sheet having a primary combustion air hole through the top sheet; a gas burner cup mounted to the top sheet; and a gas burner base mounted to the burner cup. The primary combustion air hole is configured to allow first primary combustion air to flow from beneath the top sheet to the burner base, and the primary combustion air hole is located remotely from the burner cup.

In some embodiments the burner base includes a passageway from below the burner base to above the burner base, and a first primary combustion air flow path exists from below the top sheet, then through the primary air combustion hole, then through the burner cup, and then through the passageway.

Other embodiments of the invention are directed to a domestic home cooking appliance that has a cooking space, the cooking space being accessible through a door; a top sheet having a primary combustion air hole through the top sheet, the top sheet being located vertically above the cooking space; a gas burner cup mounted to the top sheet; and a gas burner base mounted to the burner cup. The primary combustion air hole is configured to allow first primary combustion air to flow from beneath the top sheet to the burner base, and the primary combustion air hole is located remotely from the burner cup.

Other embodiments of the invention are directed to a method of burning gas with a domestic home gas cooktop, the cooktop having a top sheet having a primary combustion air hole through the top sheet, a gas burner cup mounted to the top sheet, and a gas burner base mounted to the burner cup. The method includes channeling first primary combustion air from beneath the top sheet, through the primary combustion air hole, and to the burner base; mixing the primary combustion air with a supply of the gas; and burning, in the burner base, the gas mixed with the primary combustion air. The primary combustion air hole is located remotely from the burner cup.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide a solution to the problems associated with traditional top breathing burners.

Figure 1:
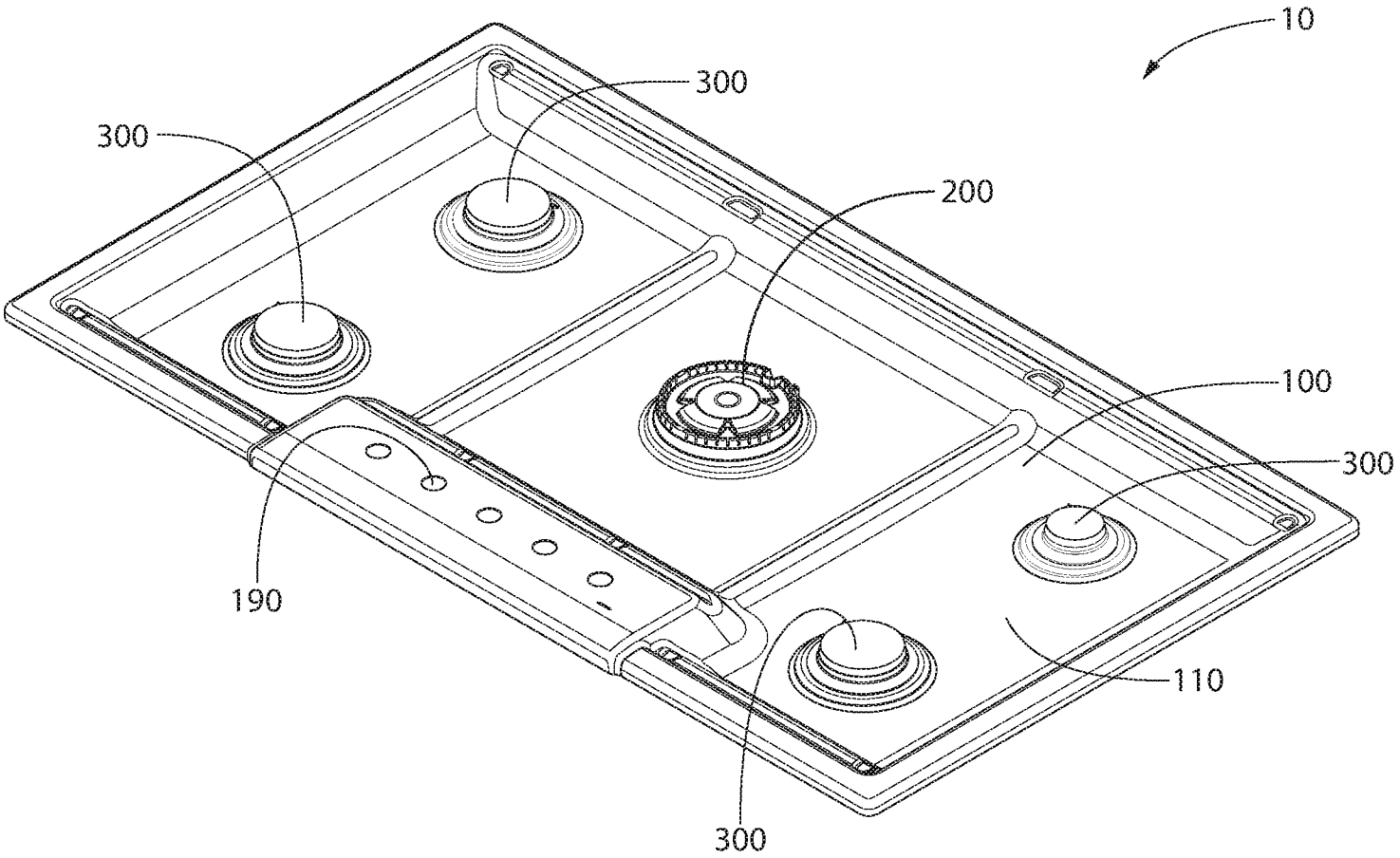
FIG. 1 is a perspective view of an exemplary cooktop in accordance with embodiments of the invention.

FIG. 1 shows an example of a cooktop 10 in accordance with embodiments of the invention. In this example, cooktop 10 has a top sheet 100 having an upper surface 110. Top sheet 100 can be sheet metal such as, for example, stainless steel, or any other appropriate material. Top sheet 100 can be formed from a sheet of metal or other material, or it can be cast, forged, or made by some other process.

In this example, top sheet 100 has five burners. Four outer burners are shown with a burner cap 300 in place, whereas a central burner is shown without a burner cap so that a burner body 200 can be seen. In this example, each of the five burners have a burner base 200 and a burner cap 300 (explained in more detail below). Each burner has a burner control that extends through a hole 190 in top sheet 100. The burner controls are omitted in this figure so that holes 190 can be seen.

Figure 2:
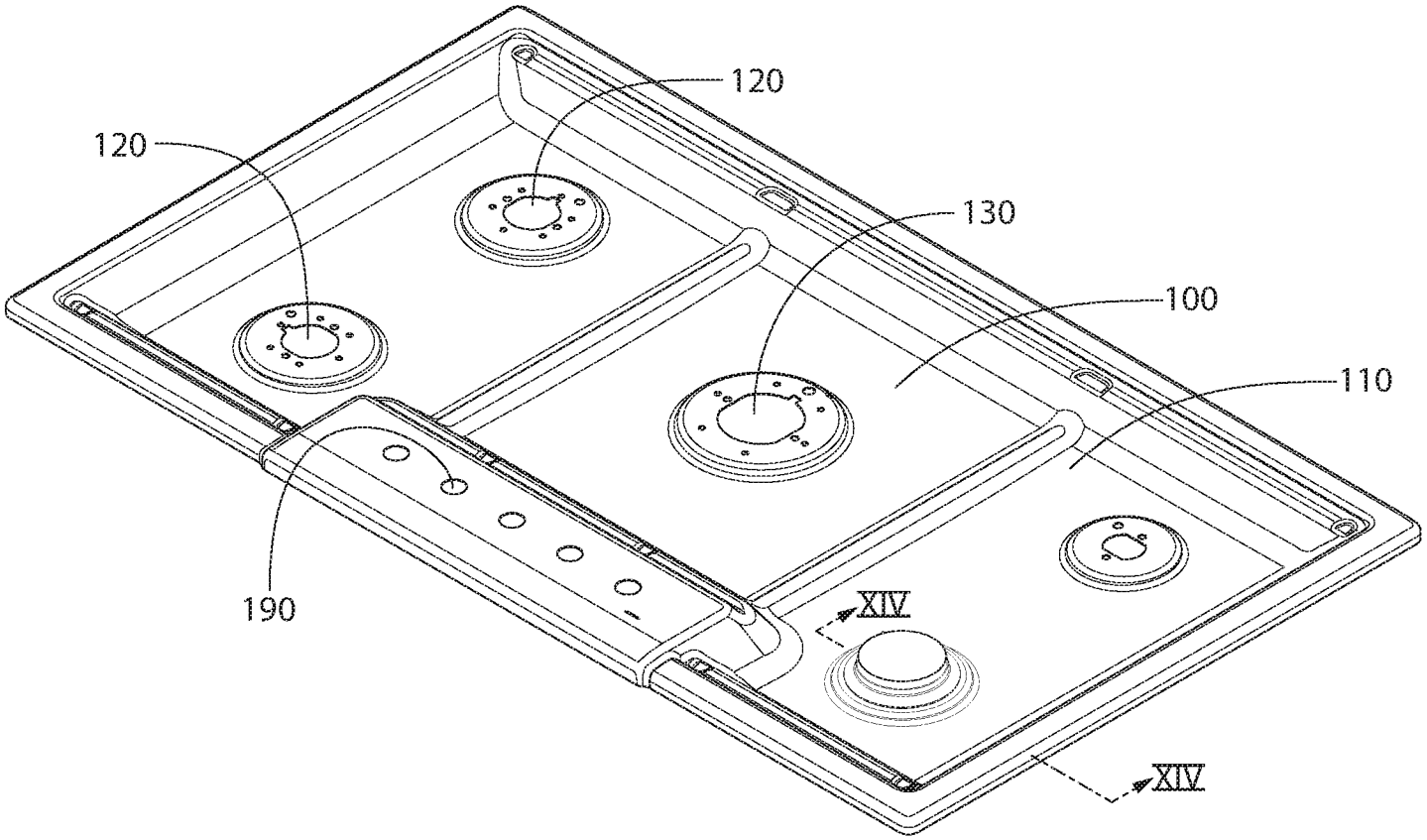
FIG. 2 is a perspective view of an exemplary top sheet in accordance with embodiment of the invention.

FIG. 2 shows top sheet 100 with four of the burners removed so that burner cup holes 120, 130 can be seen.

Figure 3:
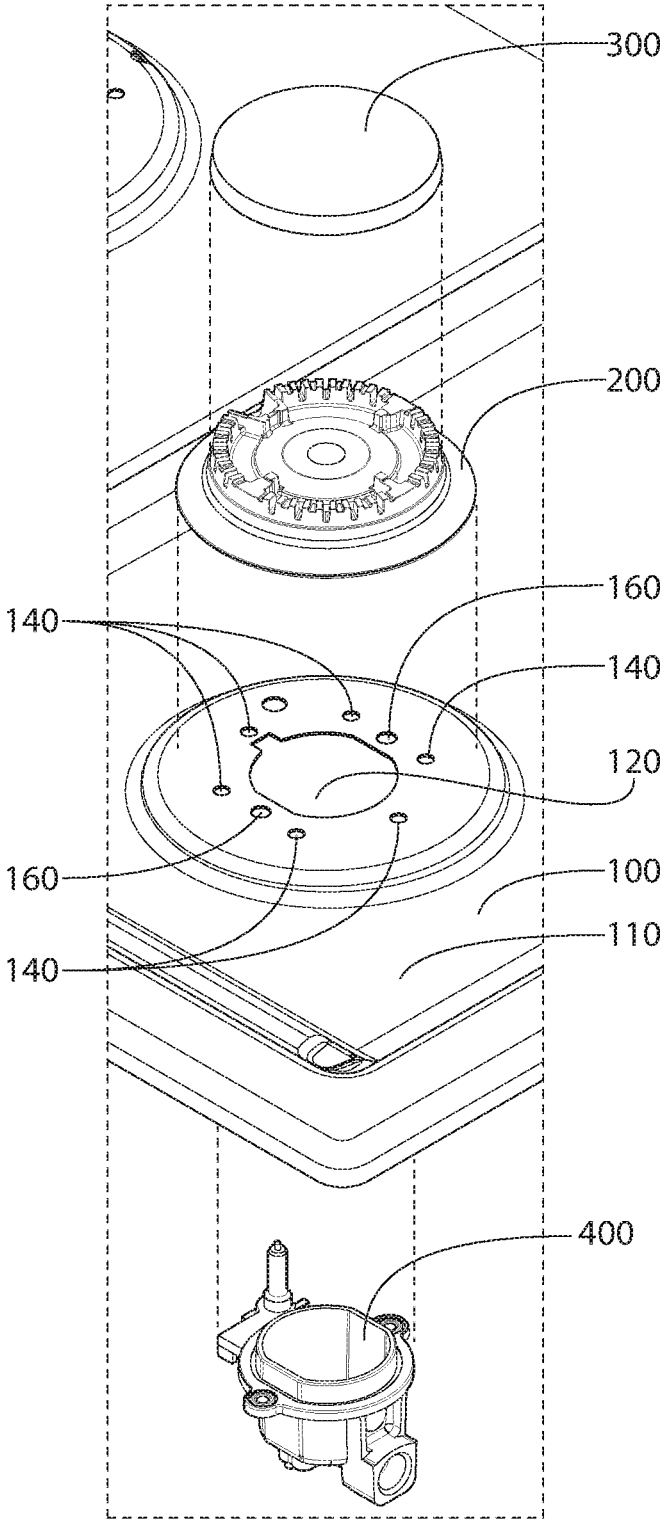
FIG. 3 is a partial exploded view of the cooktop of FIG. 1.
Figure 10:
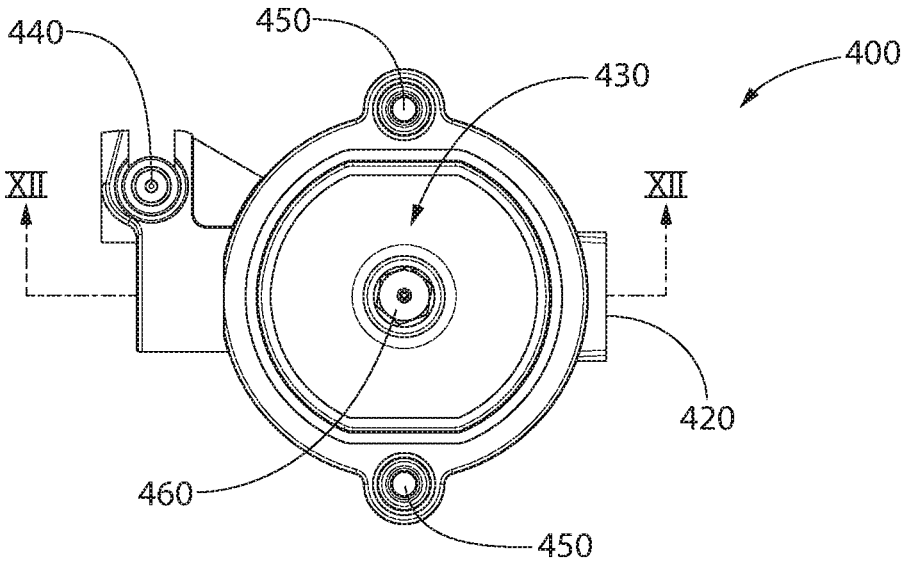
FIG. 10 is a top view of the burner cup shown in FIG. 9.
Figure 11:
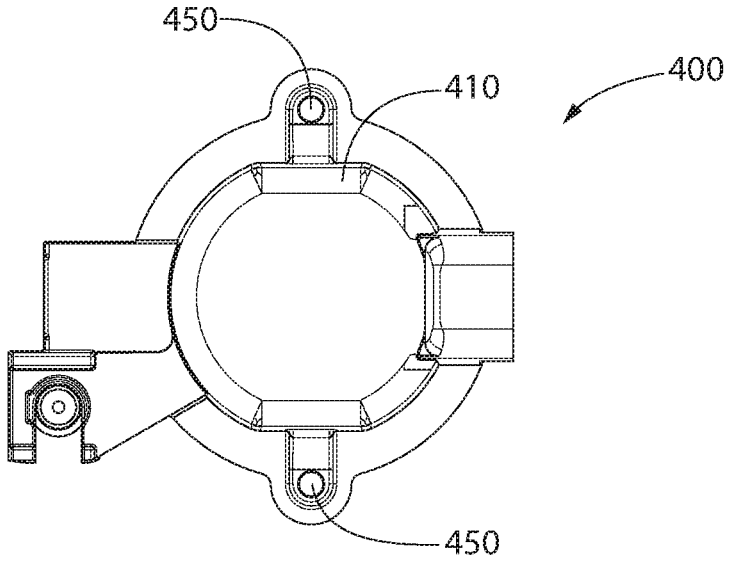
FIG. 11 is a bottom view of the burner cup shown in FIG. 9.
Figure 12:
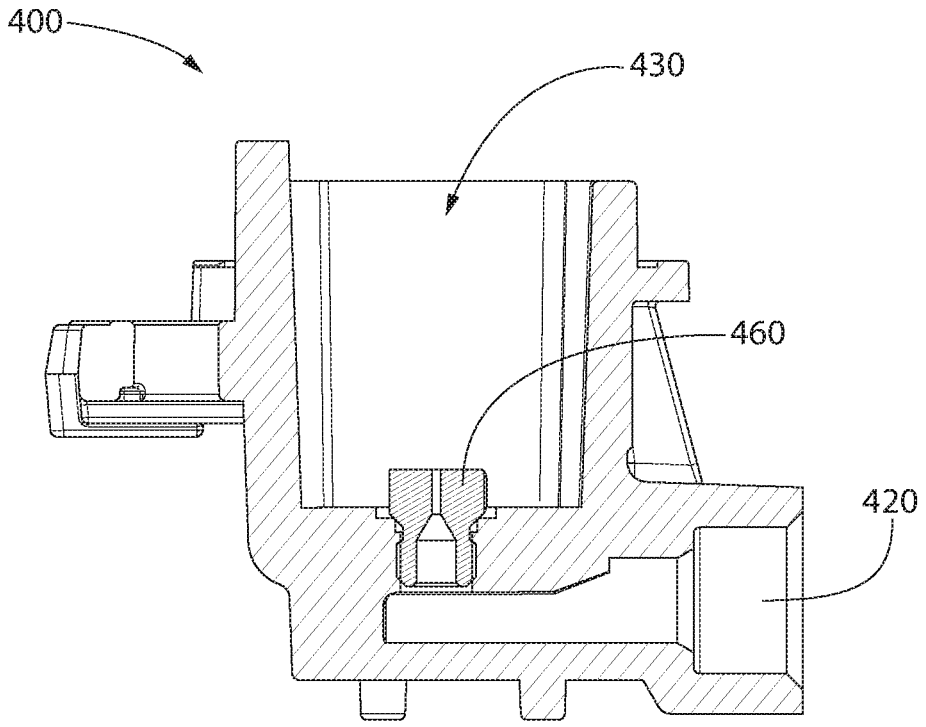
FIG. 12 is a sectional view of the burner cup shown in FIG. 9 taken along section line XII-XII in FIG. 10.

FIG. 3 shows one burner separated into its major parts. A burner cup 400 is located primarily beneath top sheet 100 and extends through burner hole 120 in top sheet 100. In this example, an upper rim of burner cup 400 extends above top sheet 100. Referring to FIG. 10, burner cup 400 has, in this example, two threaded attachment holes 450 that align with attachment holes 160 in top sheet 100. Although not shown in the figures, a bolt or other threaded fastener is inserted through each attachment hole 160 and engages one of the attachment holes 450. In other embodiments, a nut is used instead of providing threads in attachment holes 450. In still other embodiments, a non-threaded fastener such as, for example, a clip is used. After burner cup 400 is securely attached to top sheet 100, burner body 200 is set in position on burner cup 400. In this example, burner body 200 is not attached to burner cup 400, but simply rests on burner cup 400. In other examples, burner body 200 is attached to burner cup 400 by way of one or more fasteners. Burner cap 300 is set in position on top of burner body 200. In this example, burner cap 300 is not attached to burner body 200, but simply rests on burner body 200. In other examples, burner cap 300 is attached to burner body 200 by way of one or more fasteners.

Figure 4:
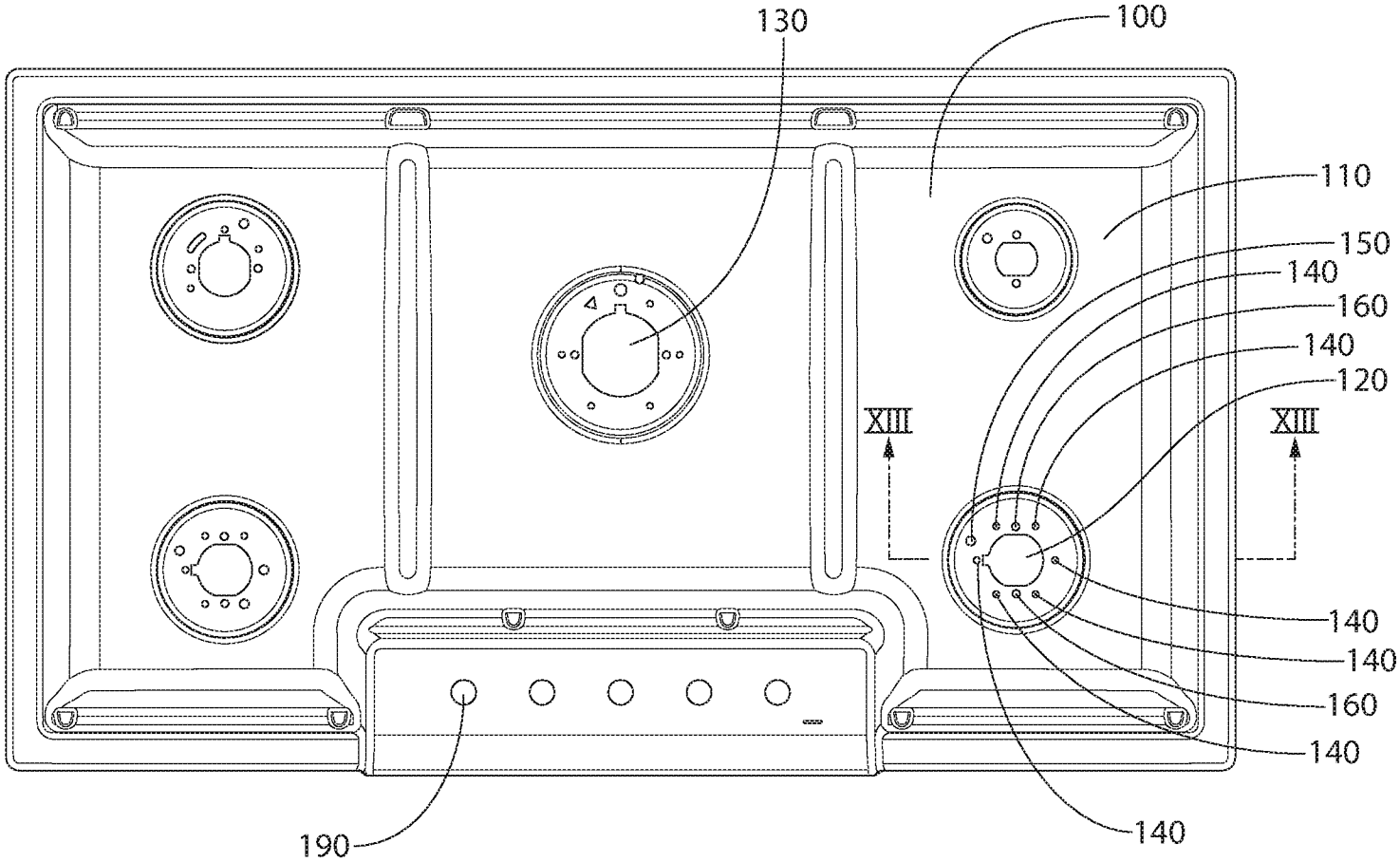
FIG. 4 is a top view of the top sheet of FIG. 2.
Figure 9:
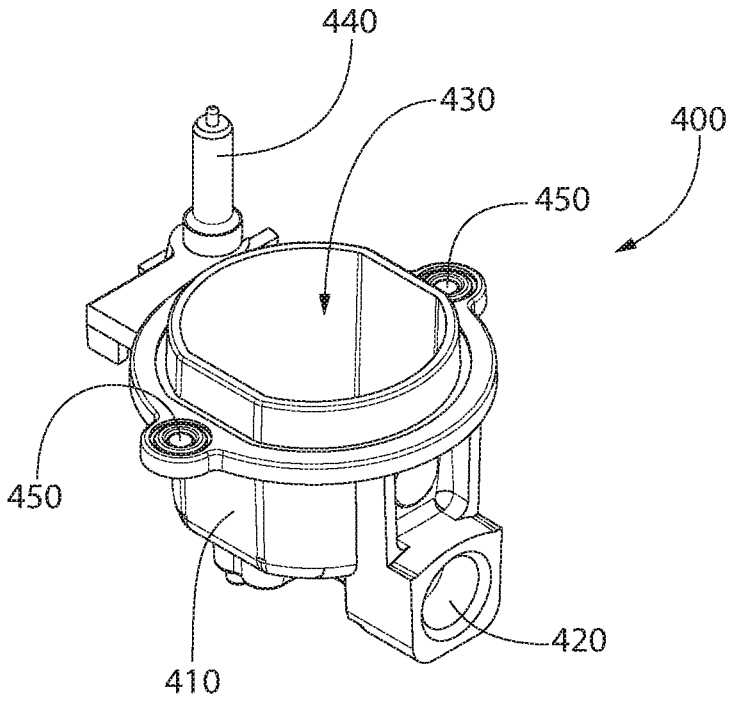
FIG. 9 is a perspective view of an exemplary burner cup in accordance with embodiments of the invention.

FIGS. 3 and 4 show a plurality of holes in top sheet 100. As explained above, burner cup 400 extends through burner hole 120 (or 130 in the case of the central burner) and burner cup 400 is attached to top sheet 100 through (in this example) two attachment holes 160. In other examples, fewer or more attachment holes 160 can be used. An igniter hole 150 is provide in top sheet 100 to allow an igniter 440 (explained in more detail below in relation to FIG. 9) to extend through top sheet 100.

In addition to the various holes in top sheet 100 discussed above, a number (in this example six) primary combustion air holes 140 are provided in top sheet 100. Primary combustion air holes 140 provide a passageway between the area below top sheet 100 and the area above top sheet 100 to allow air to flow from below top sheet 100 up through top sheet 100 and into a position where it can be drawn into burner cup 400. While primary combustion air holes 140 are shown round and symmetrically located in this example, primary air combustion holes can be any other shape such as, for example, oval, slot-shaped, or polygonal. Primary air combustion holes can also be located in any configuration and orientation around burner cup 400, as shown in the other burner locations in FIG. 4.

The location, size, and shape of the primary combustion air holes can be used to tune the flame of a particular burner. For example, primary air combustion holes can be placed only on a side of the burner cup that is opposite to a cabinet door that is located below the cooktop in order to reduce the effect of the concussion and/or back pressure. Primary air combustion holes can also be sized and located to counteract the air pressure effects of adjacent burners. Also, if the flame is too long or the flame angle is too low on one side of the burner versus another, the flame can be optimized by strategically placing the primary air combustion holes to achieve the desired flame characteristics.

Figure 5:
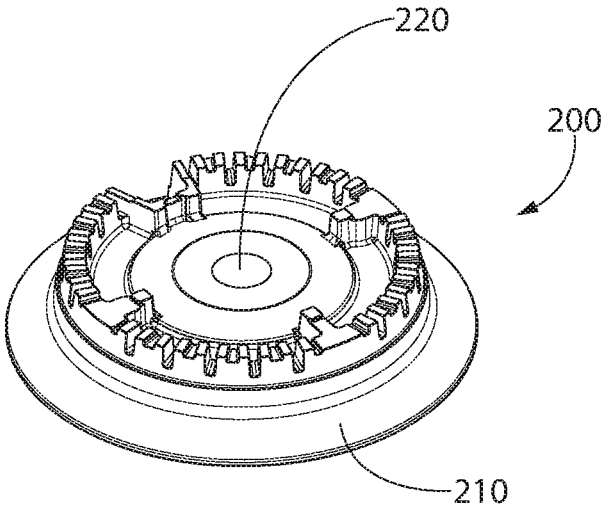
FIG. 5 is a perspective view of an exemplary burner base in accordance with embodiments of the invention.
Figure 6:
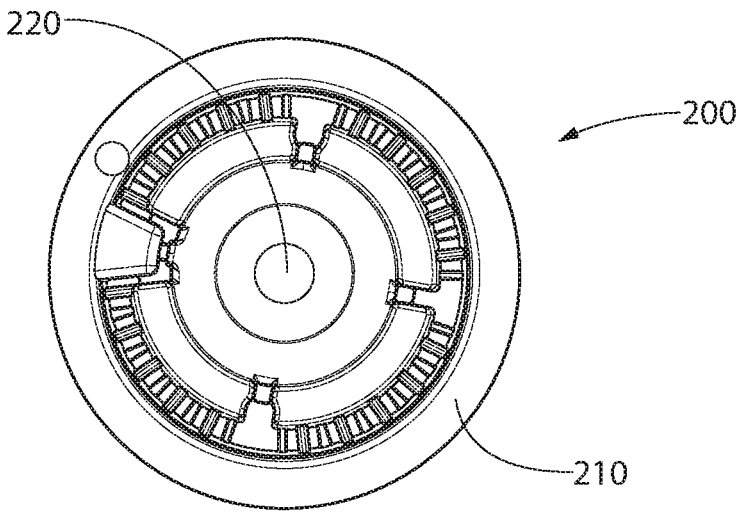
FIG. 6 is a top view of the burner base shown in FIG. 5.
Figure 7:
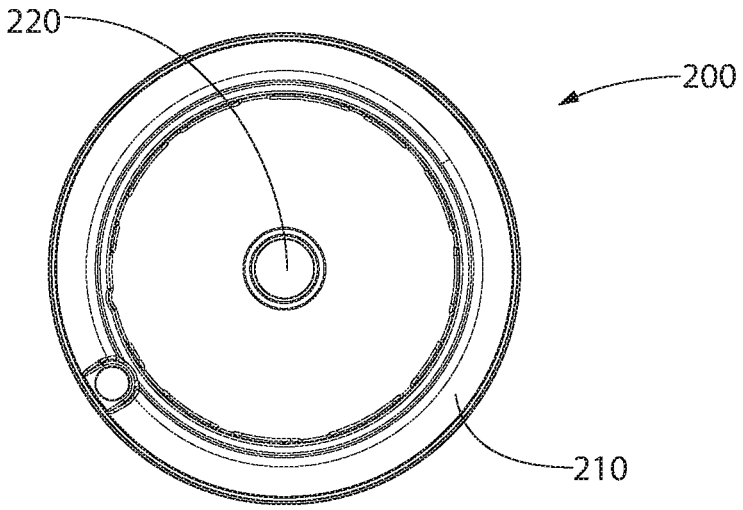
FIG. 7 is a bottom view of the burner base shown in FIG. 5.
Figure 8:
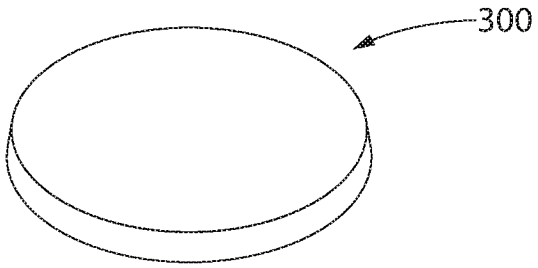
FIG. 8 is a perspective view of an exemplary burner cap in accordance with embodiments of the invention.

FIG. 5 shows an example of burner body 200 in accordance with embodiments of the invention. In this example, burner body 200 has a skirt 210 that extends radially and a gas/air passage 220 that extends along a central axis of burner body 200. FIG. 6 is a top view of burner body 200 and FIG. 7 is a bottom view of burner body 200. As can be seen in FIGS. 5 and 6, burner body 200 has a plurality of fins extending upward that create small passageways through which a gas/air mixture flows radially. Burner cap 300, in this example, sits on the top of the fins of burner body 200 to form the top surface of the small passageways FIG. 8 shows an example of a round burner cap 300. Other embodiments have burner caps that are shapes other than round. For example, burner cap 300 can be polygonal or oval. In some embodiments, the burner cap is the same shape as the burner body so that, as described above, the burner cap can form the top surface of the small passageways through which the gas/air mixture flows radially.

FIGS. 9-12 show burner cup 400 in more detail. In this example, burner cup 400 has a main body 410 that is generally cylindrical in shape. Burner cup 400 has a gas inlet 420 that is, in embodiments, connected to a gas control valve that controls the amount of gas fed to burner cup 400. The gas control valve (not shown) is connected to a gas source that supplies the gas to the gas control valve. Burner cup 400 has a gas jet 460 that, in this example, introduces, in a controlled manner, the gas from gas inlet 420 to a central area 430 in burner cup 400. The gas in mixed with air in central area 430 (explained in more detail below). In this example, igniter 440 is mounted to burner cup 400. Igniter 440, in this example, creates a spark between igniter 440 and burner cap 300. The spark ignites the gas/air mixture that flows, in this example, radially outward through the small gas/air passages between burner body 200 and burner cap 300.

Figure 13:
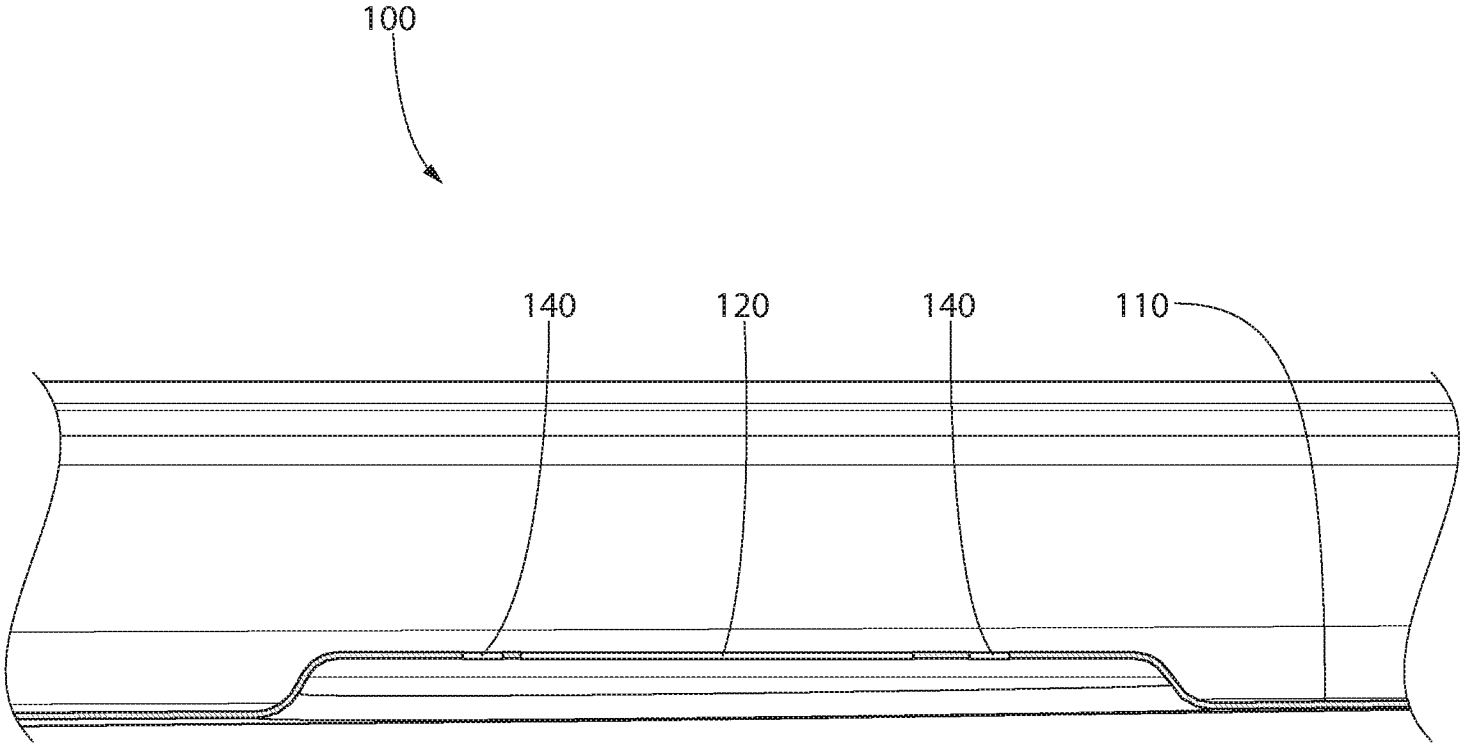
FIG. 13 is a partial sectional view of an exemplary top sheet in accordance with embodiments of the invention.

FIG. 13 is a partial sectional view through top sheet 100 taken along section line XIII-XIII in FIG. 4. FIG. 13 shows that primary combustion air holes 140 are located in top sheet 100 outside of burner hole 120. In this example, top sheet 100 has a raised area where burner cup 400 is attached to top sheet 100. In embodiments, this raised area helps divert spills away from burner cup 400 and primary combustion air holes 140.

Figure 14:
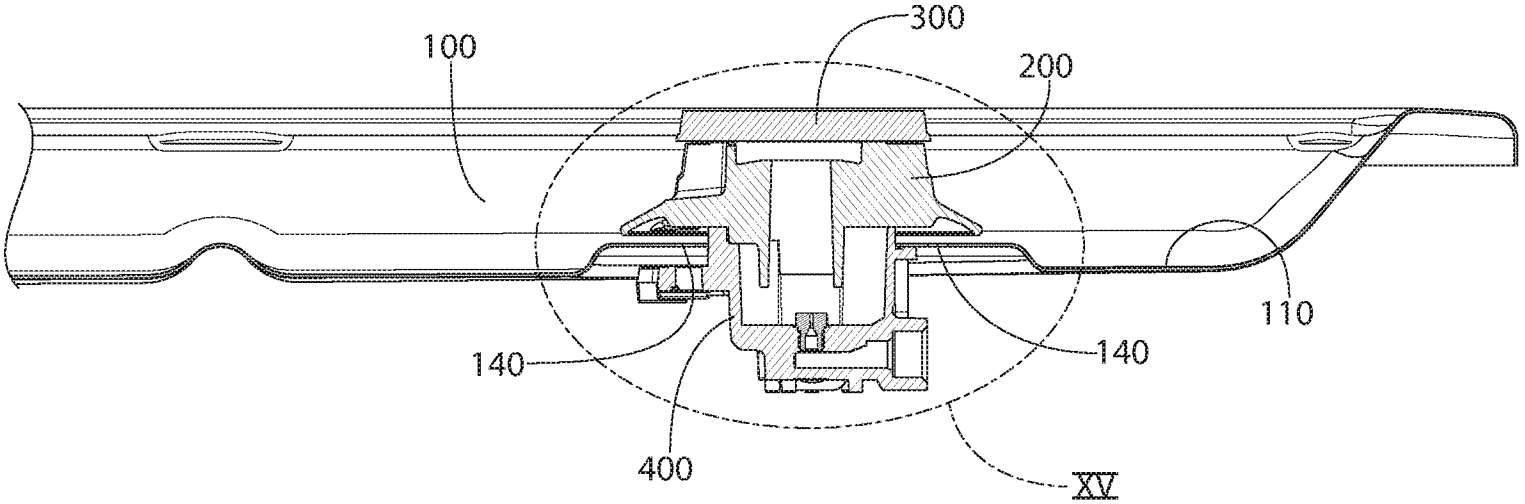
FIG. 14 is a partial sectional view taken along section line XIV-XIV in FIG. 2.
Figure 15:
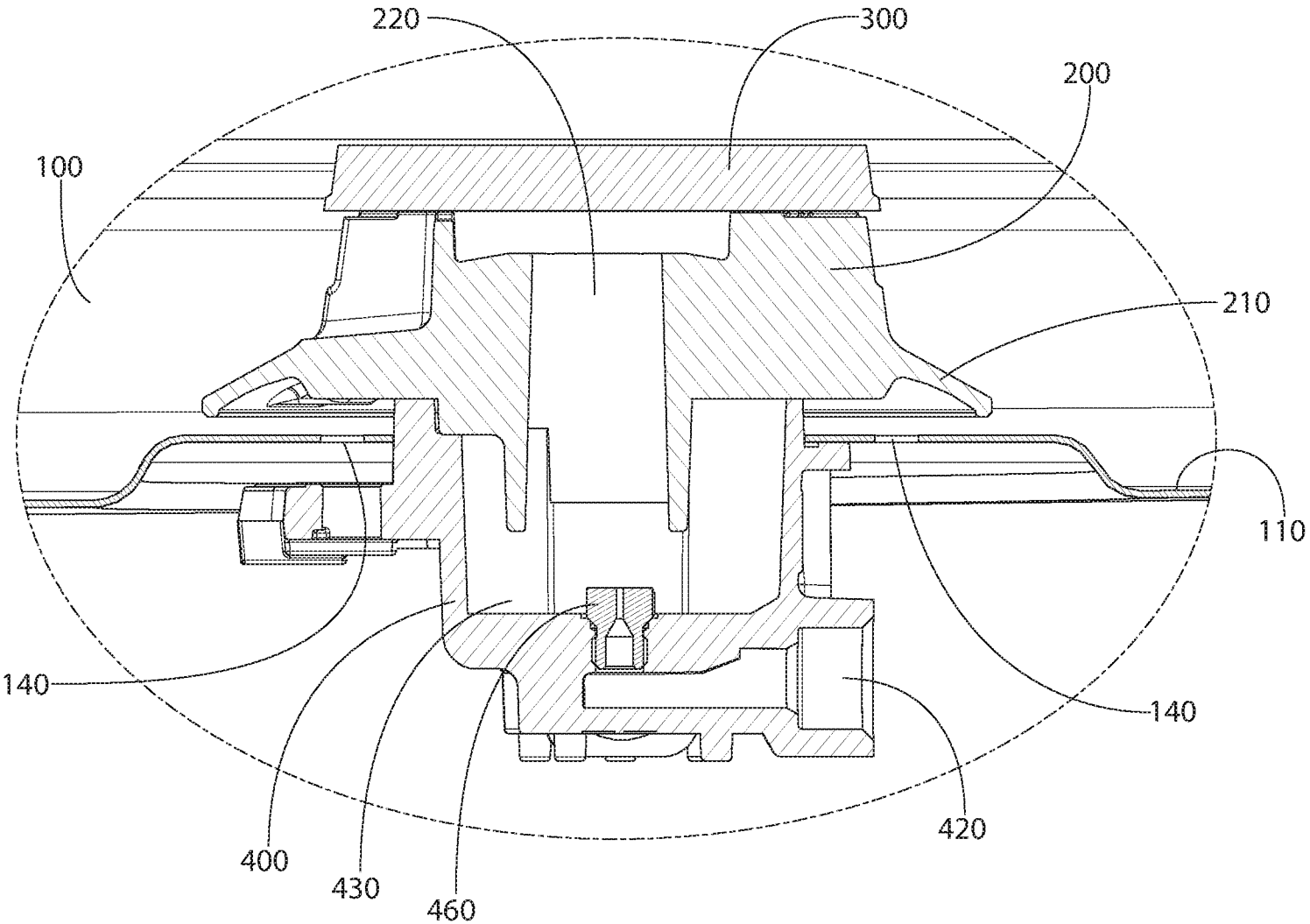
FIG. 15 is partial sectional view of the area XV in FIG. 14.

FIG. 14 is a partial sectional view taken along section line XIV-XIV in FIG. 2 and shows the relative positions of top sheet 100, burner cup 400, burner body 200, and burner cap 300. FIG. 15 is a larger scale view of area XV in FIG. 14. Burner cup 400 is positioned from below top sheet 100 such that its upper rim extends above top sheet 100. Burner body 200 sits on burner cup 400 and partially extends into central section 430 of burner cup 400 such that gas/air passage 220 of burner body 200 is fluidly connected to central section 430 of burner cup 400. Primary combustion air can flow from under top sheet 100, upward through primary combustion air holes 140, up under skirt 210 of burner body 200, over the upper rim of burner cup 400, down into central section 430 of burner cup 400, mix with gas emitted from gas jet 460, then flow up through gas/air passage 220 and radially out through the small passageways between burner body 200 and burner cap 300. This flow path is described in more detail in relation to FIG. 19 below.

Figure 16:
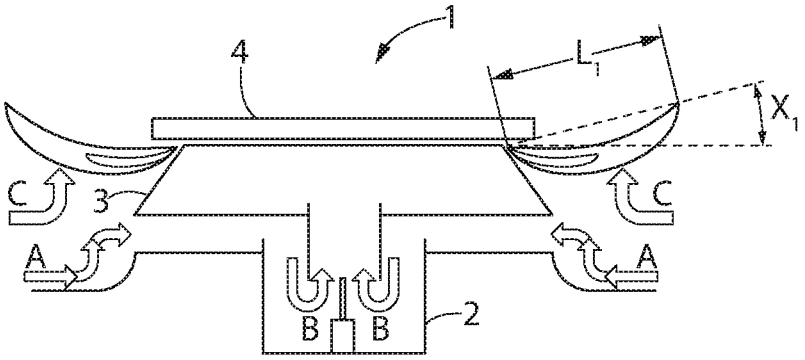
FIG. 16 is a schematic side view of a burner.

FIG. 16 shows an example of a top breathing burner 1 that draws primary combustion air from above the top sheet only (arrows A). The primary combustion air flows between the top sheet and burner body 3 and then down in to burner cup 2. While in burner cup 2, the primary combustion air flows upward (arrows B) and mixes with gas emitted from a gas jet. The gas/air mixture then flows through burner body 3 and radially outward where it is ignited and burns. The flames are then supplemented with secondary combustion air C that flows in from around burner body 3. Because this configuration relies on the secondary combustion air to a great extent, the flames are drawn downward toward the top sheet and extended away from burner body 3 (indicated by angle $X_1$ and a flame length $L_1$). Long, low flames such as this can cause discoloration in the top sheet due to heat from the flames and do not efficiently provide heat to the cooking vessel.

Figure 17:
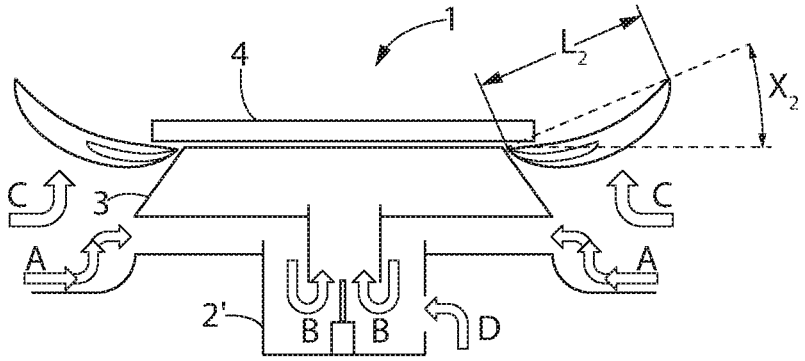
FIG. 17 is a schematic side view of a burner.

FIG. 17 shows a modified version of the top breathing burner shown in FIG. 16. In this version, a hole is provided in the side of burner cup 2' to allow primary combustion air D to flow into burner cup 2'. Primary combustion air D can somewhat reduce the amount of secondary combustion air C that is needed. As a result, the flame length $L_2$ can be shorter than flame length $L_1$ and angle $X_2$ can be larger than angle $X_1$. This configuration can provide increased efficiency and decreased discoloration of the top sheet compared to the configuration shown in FIG. 16. However, the configuration in FIG. 17 can have undesirable traits.

The configuration shown in FIG. 17 can have a low resistance to concussion disturbance resulting from, for example, a cabinet door being opened or closed quickly. Cooktops are often installed in a cabinet which includes doors which open to a storage area below the cooktop. When these doors are opened or closed quickly, the air pressure inside the cabinet can change quickly. This change in air pressure can be transmitted to the area below the top sheet of the cooktop. The configuration shown in FIG. 17 can be susceptible to this concussion disturbance because the hole in burner cup 2' is located on one side of burner cup 2' and is relatively large compared to the primary combustion air passageway between the top sheet and burner body 3 (the source of the other primary combustion air). The configuration shown in FIG. 17 is also susceptible to back pressure, which is negative pressure caused by companion appliances operated in combination with the burner. Companion appliance can draw air from the same source (space) as the cooktop and thus create negative pressure in that space, making it harder for the burner to draw combustion air from the space. The concussion disturbance or back pressure can in some cases extinguish the burner flame. The large hole in burner cup 2' is also susceptible to spills reaching the area below the top sheet.

Figure 18:
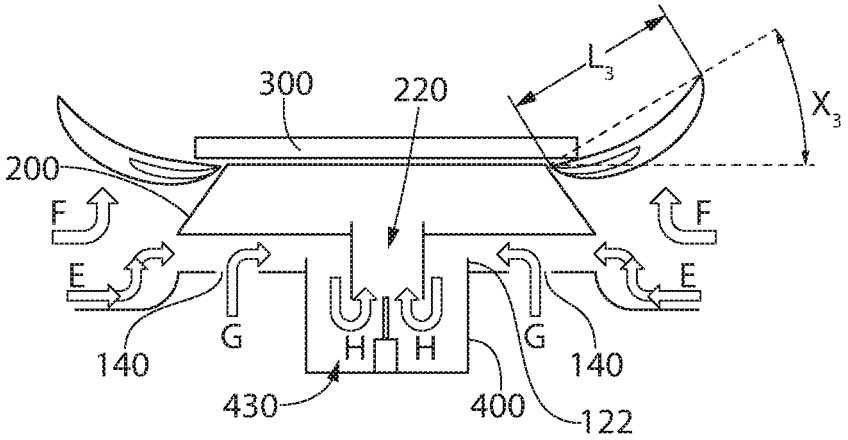
FIG. 18 is a schematic side view of an exemplary burner in accordance with embodiments of the invention.

FIG. 18 is a schematic representation of exemplary embodiments of the invention. FIG. 18 shows primary combustion air E flowing in from above the top sheet and under burner body 200 similarly to FIGS. 16 and 17. However, FIG. 18 shows additional primary combustion air G flowing through primary combustion air holes 140 from below the top sheet. Both primary combustion air E and primary combustion air G flow over the upper lip of burner cup 400 and into central area 430 of burner cup 400. The combined primary combustion air then flows upward (arrows H), mixes with gas from the gas jet, and into gas/air passage 220 of burner body 200. This increased volume of primary combustion air can reduce the amount of secondary combustion air F that is needed. As a result, the flame length $L_3$ can be shorter than flame length $L_1$ and angle $X_3$ can be larger than angle $X_1$. This configuration can provide increased efficiency and decreased discoloration of the top sheet compared to the configuration shown in FIG. 16. However, the configuration shown in FIG. 18 has advantages over the configuration shown in FIG. 17.

Primary combustion air holes 140, compared to a hole in the burner cup, provide more resistance to concussion disturbance and back pressure. This is due, at least in part, to (1) the smaller cross section of primary combustion air holes 140 as compared to a hole in the side of the burner cup, and (2) primary combustion air holes 140 being farther away from the gas jet. The smaller cross section of primary combustion air holes 140 creates more of a choke restriction than does a hole in the side of the burner cup, resulting in a damped or spread-out (and thus less severe) reaction to changes in pressure in the space below the top sheet. The location of the primary combustion air holes being more remote from the gas jet also results in a damped or spread-out (and thus less severe) impact on the gas jet from changes in pressure in the space below the top sheet. The smaller cross section of the primary combustion air holes also provides more protection against spills reaching the space below the top sheet as a result of surface tension of the liquid spilled.

Another advantage to embodiments of the invention as compared to providing a hole in the side of the burner cup is that making the primary combustion air holes in the top sheet is less expensive than providing a hole in the burner cup (which can be a cast or machined part). In addition, providing multiple different configurations (different number, sizes, and/or locations) of the primary combustion air holes can be easily and inexpensively achieved as compared to requiring multiple different burner cups. The primary combustion air holes can be laser (or otherwise) cut in the top sheet either during production of the top sheet or afterwards relatively simply and inexpensively.

FIG. 18 shows a vertical, in this example, protrusion 122 that protrudes into the flow path of primary combustion air G. Protrusion 122 can act as a choke to regulate primary combustion air G and act as a buffer to reduce concussion and/or back pressure effects on the flame. While protrusion 122 is shown near burner cup 400 in this example, in other embodiments, protrusion 122 is a lip formed in top sheet 100 around one or more of the primary combustion air holes, or a crease, wave, or other formation in top sheet 100 remote from the primary combustion air holes. One or more of these configurations can also act as a drip barrier to help prevent drips from entering burner cup 400 or passing through top sheet 100.

Figure 19:
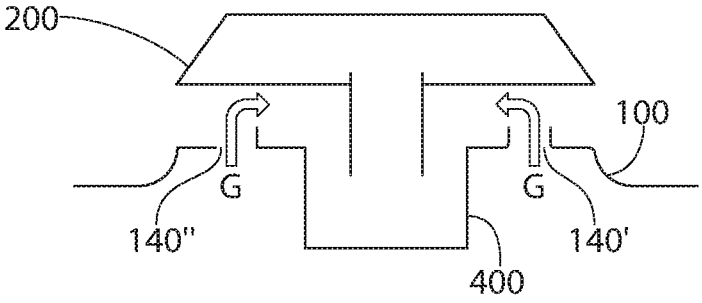
FIG. 19 is a schematic side view of an exemplary top sheet in accordance with embodiments of the invention.

FIG. 19 shows an example of an embodiment of the invention in which primary combustion air hole 140' has a lip formed around the entire perimeter of primary combustion air hole 140'. Primary combustion air hole 140" has a lip formed only part way around the perimeter of primary combustion air hole 140". The extent of the lip extending around the primary combustion air hole and the height of the lip can be tailored to the amount of choking or buffering required in the particular application. Further, some of the primary combustion air holes can include a full or partial lip while others do not. Further still, some primary combustion air holes can have lips of a different height than other primary combustion air holes. Further still, some of the lips of the primary combustion air holes can have radiused corners like primary combustion air hole 140', while the lips of other primary combustion air holes can have sharp corners like primary combustion air hole 140".

Figure 20:
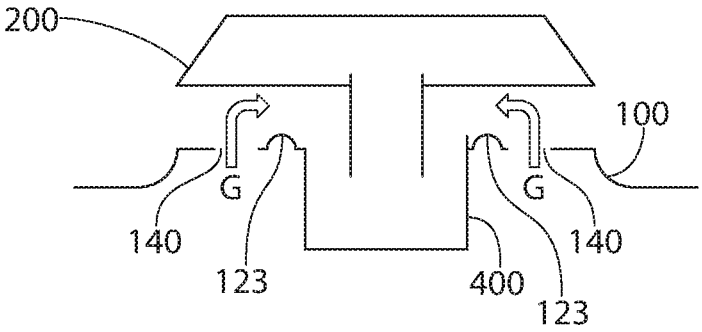
FIG. 20 is a schematic side view of an exemplary top sheet in accordance with embodiments of the invention.

FIG. 20 shows an example of an embodiment of the invention in which top sheet 100 includes a protrusion 123 that creates a choke point between top sheet 100 and burner base 200. In this example, protrusion 123 is formed in the top sheet and extends completely around burner cup 400 to form a continuous circular bump in top sheet 100. Other embodiments provide a series of protrusions or bumps that form a non-continuous formation around burner cup 400. The example shown in FIG. 20 has a smooth semi-circular cross section. However, other embodiments have flatter, more gradual cross sections, less gradual cross sections, angular cross sections, or any other cross section that achieves the desired choking or buffering.

FIGS. 18-20 show various examples of features that provide a choking or buffering effect. It is noted, that any combination of any of the features shown and/or discussed can be used to provide the desired choking or buffering effect.

Figure 21:
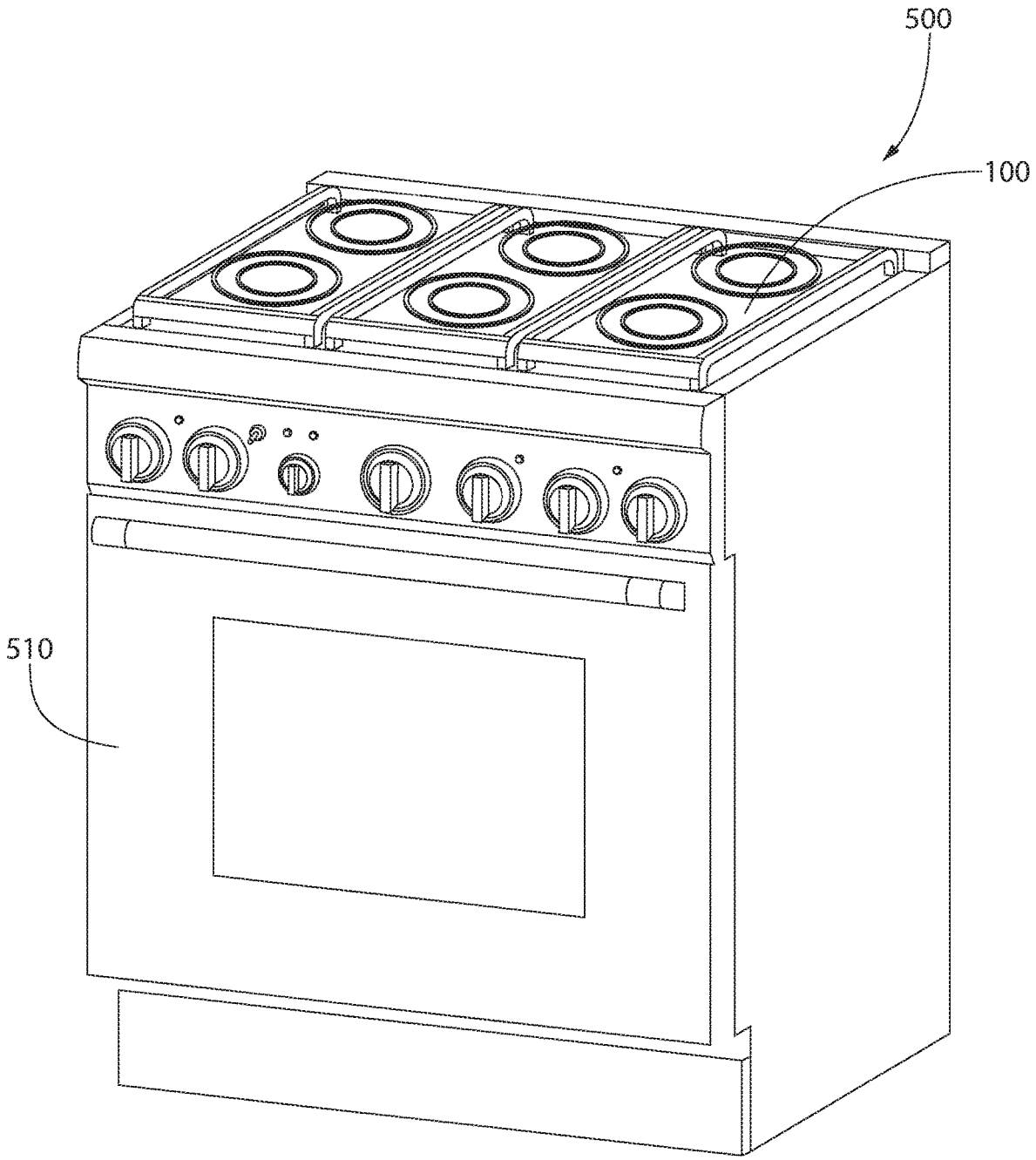
FIG. 21 is a perspective view of an exemplary cooking appliance in accordance with embodiments of the invention.

FIG. 21 shows an example of a kitchen appliance 500 in accordance with embodiments of the invention. Appliance 500, in this example, has a cooktop 100 and a cooking space accessible by way of a door 510.

Figure 22:
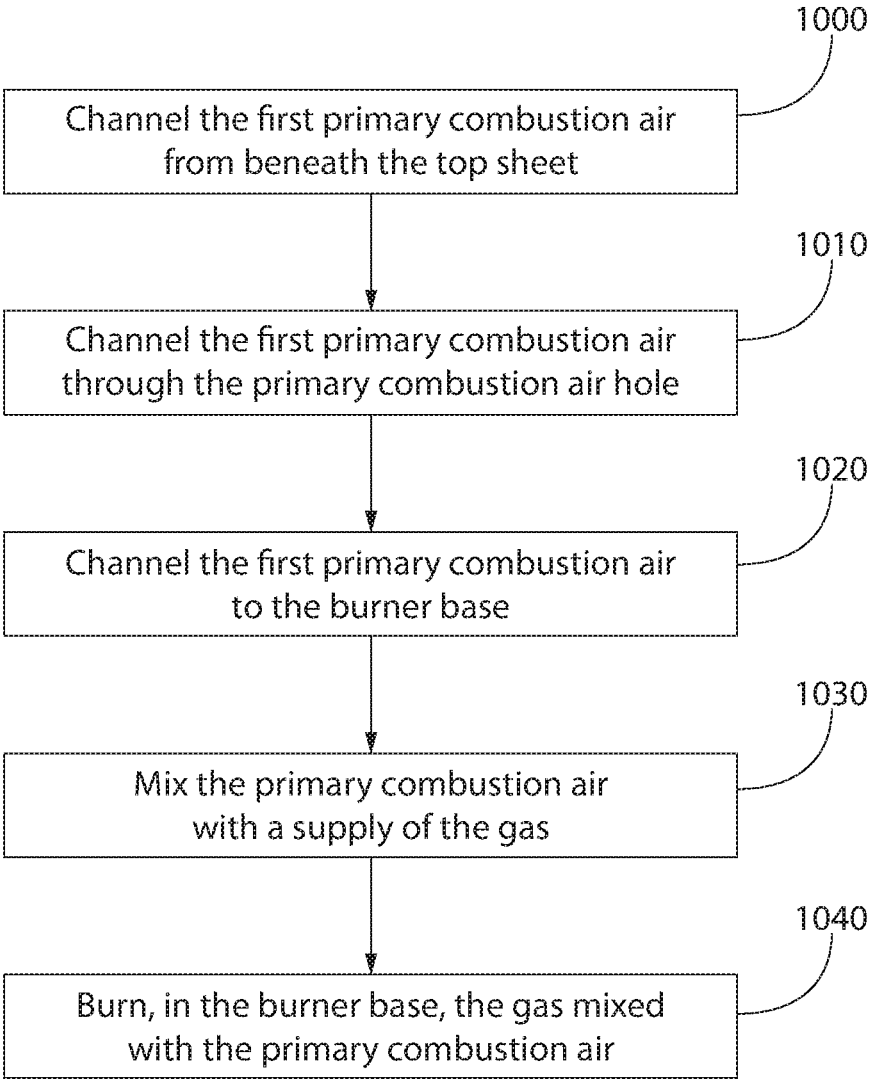
FIG. 22 is a flow chart showing an exemplary method in accordance with embodiments of the invention.

FIG. 22 shows an example of a method in accordance with embodiments of the invention. At step 1000 primary combustion air is channeled from beneath the top sheet. At step 1010 the primary combustion air is channeled though the primary combustion air hole. At step 1020 the primary combustion air is channeled to the burner base. At step 1030 the primary combustion air is mixed with a supply of gas. And at step 1040 the gas mixed with primary combustion air is burned in the burner base.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic home gas cooktop, comprising:
a top sheet having a primary combustion air hole through the top sheet;
a gas burner cup mounted to the top sheet; and
a gas burner base mounted to the burner cup,
wherein the primary combustion air hole is configured to allow first primary combustion air to flow from beneath the top sheet to the burner base, and
the primary combustion air hole is located remotely from the burner cup.

2. The cooktop of claim 1, further comprising a burner cap mounted to the burner base.

3. The cooktop of claim 1, wherein the burner base comprises a passageway from below the burner base to above the burner base, and
a first primary combustion air flow path exists from below the top sheet, then through the primary air combustion hole, then through the burner cup, and then through the passageway.

4. The cooktop of claim 3, wherein the primary combustion air hole comprises a plurality of primary combustion air holes.

5. The cooktop of claim 4, wherein the plurality of primary combustion air holes are arranged around a perimeter of the burner cup.

6. The cooktop of claim 5, wherein the plurality of primary combustion air holes are arranged symmetrically around a perimeter of the burner cup.

7. The cooktop of claim 6, wherein the burner base extends radially from a vertical central axis of the burner base.

8. The cooktop of claim 7, wherein the plurality of primary combustion air holes are located vertically beneath the burner base in a direction parallel to the vertical central axis of the burner base.

9. The cooktop of claim 8, wherein a space exists vertically between the burner base and the top sheet, and
a second primary combustion air flow path exists from radially outside of the burner base, then through the space, then through the burner cup, and then through the passageway.

10. The cooktop of claim 9, wherein the first primary combustion air flow path and the second primary combustion air flow path converge in the space.

11. The cooktop of claim 3, wherein the burner base extends radially from a vertical central axis of the burner base.

12. The cooktop of claim 11, wherein the primary combustion air hole is located vertically beneath the burner base in a direction parallel to the vertical central axis of the burner base.

13. The cooktop of claim 12, wherein a space exists vertically between the burner base and the top sheet, and
a second primary combustion air flow path exists from radially outside of the burner base, then through the space, then through the burner cup, and then through the passageway.

14. The cooktop of claim 13, wherein the first primary combustion air flow path and the second primary combustion air flow path converge in the space.

15. A domestic home cooking appliance, comprising:
a cooking space, the cooking space being accessible through a door;
a top sheet having a primary combustion air hole through the top sheet, the top sheet being located vertically above the cooking space;

a gas burner cup mounted to the top sheet; and a gas burner base mounted to the burner cup, wherein the primary combustion air hole is configured to allow first primary combustion air to flow from beneath the top sheet to the burner base, and the primary combustion air hole is located remotely from the burner cup.

16. The appliance of claim 15, wherein the burner base comprises a passageway from below the burner base to above the burner base, and a first primary combustion air flow path exists from below the top sheet, then through the primary air combustion hole, then through the burner cup, and then through the passageway.

17. The appliance of claim 16, wherein the burner base extends radially from a vertical central axis of the burner base, and the primary combustion air hole is located vertically beneath the burner base in a direction parallel to the vertical central axis of the burner base.

18. The appliance of claim 17, wherein a space exists vertically between the burner base and the top sheet, and a second primary combustion air flow path exists from radially outside of the burner base, then through the space, then through the burner cup, and then through the passageway.

19. The appliance of claim 18, wherein the first primary combustion air flow path and the second primary combustion air flow path converge in the space.

20. A method of burning gas with a domestic home gas cooktop, the cooktop having a top sheet having a primary combustion air hole through the top sheet, a gas burner cup mounted to the top sheet, and a gas burner base mounted to the burner cup, the method comprising:

channeling first primary combustion air from beneath the top sheet, through the primary combustion air hole, and to the burner base;

mixing the primary combustion air with a supply of the gas; and burning, in the burner base, the gas mixed with the primary combustion air, wherein the primary combustion air hole is located remotely from the burner cup.

* * * * *